United States Patent [19]

Werffeli

[11] 4,292,868

[45] Oct. 6, 1981

[54] TEXTILE SPOOLING MACHINE, AN APPARATUS AND METHOD TO PREVENT THE FORMATION OF LOOSE CUT THREAD PIECES

[75] Inventor: Hermann Werffeli, Horgen, Switzerland

[73] Assignee: Maschinenfabrik Schweiter AG, Horgen, Switzerland

[21] Appl. No.: 125,137

[22] Filed: Feb. 27, 1980

[30] Foreign Application Priority Data

Mar. 8, 1979 [CH] Switzerland ..... 2243/79

[51] Int. Cl.[3] ..... B65H 63/02; B65H 63/06

[52] U.S. Cl. ..... 83/13; 28/227; 83/58; 83/66; 83/364; 83/366; 83/371; 83/399; 242/36

[58] Field of Search ..... 83/13, 58, 66, 67, 364, 83/366, 371, 399; 28/227; 242/36, 37 R, 19, 45; 73/160; 226/11; 340/668, 675; 361/170; 364/563, 475

[56] References Cited

U.S. PATENT DOCUMENTS

| | | | |
|---|---|---|---|
| 3,270,930 | 9/1966 | Emerson | 340/675 X |
| 3,343,008 | 9/1967 | Bancroft | 340/675 X |
| 3,438,188 | 4/1969 | Boggs | 242/37 R |
| 3,476,329 | 11/1969 | Felix | 28/227 X |
| 3,511,448 | 5/1970 | Brouwer et al. | 28/227 X |
| 3,519,922 | 7/1970 | Nash et al. | 340/675 X |
| 3,613,065 | 10/1971 | Lindemann et al. | 340/668 |
| 3,704,610 | 12/1972 | Geipel et al. | 83/399 X |
| 3,938,119 | 2/1976 | Schwartz | 226/11 X |
| 4,016,790 | 4/1977 | Felix et al. | 28/227 X |

FOREIGN PATENT DOCUMENTS 439791 12/1967 Switzerland .

*Primary Examiner*—Frank T. Yost

*Attorney, Agent, or Firm*—Frishauf, Holtz, Goodman & Woodward

[57] ABSTRACT

High-speed spooling machines for yarn or thread are subject to the difficulty that, if the yarn or thread should break between a yarn cleaning, that is, size sensing and cutting apparatus and the takeup spool, stray remnant filamentary pieces may occur due to operation of the cutter apparatus since the thread size sensing apparatus may provide an erroneous "cut" signal upon absence of any thread in the sensing field. To prevent such operation, a thread sensing element is interposed in the path of the thread being spooled which, upon break of thread, will provide a "no tension" signal which will be below a predetermined threshold level. This signal is then used to inhibit operation of the cutter, regardless of the output of the thread size sensing element. To permit proper operation of the sensing unit in spite of short-time failure to sense thread tension, the "off-size" signal is preferably stored for a predetermined period, for example one second, and applied with this delay to the cutter apparatus, so that short time loss of sensed tension is not overriden but complete yarn breakage will not result in cutting action.

7 Claims, 3 Drawing Figures

TEXTILE SPOOLING MACHINE, AN APPARATUS AND METHOD TO PREVENT THE FORMATION OF LOOSE CUT THREAD PIECES

The present invention relates to textile machinery, and more particularly to textile high-speed spooling machines to spool thread or yarn, or other filaments from a supply spool or pirn to a receiving yarn package.

BACKGROUND AND PRIOR ART

Spooling machines customarily include a thread sensing apparatus to determine if the thread, yarn, or other filamentary material is within predetermined size limits. When the size limits are exceeded, that is, if the thread is too thick or too thin, the thread sensing element provides an "off-size" electrical signal which is applied to a cutting apparatus to cut the yarn or thread being spooled, so that defective pieces can be eliminated from the yarn or thread being spooled on the takeup package. Apparatus of this type require maintenance of an essentially constant filament tension. To determine the tension, a thread brake is placed in the path of the filament which is coupled to an automatic control arrangement to maintain the thread tension at a predetermined level with respect to a set reference.

If the filament being spooled should break which, in most instances, occurs just before it is being wound on the package, the tension is lost. Loss of tension distorts the position of the filaments in the thread quality or size sensing apparatus and causes the thread size sensing apparatus to provide an "off-size" signal. Consequently, the thread cutting apparatus will respond and cut the thread at the cutting position. The thread breakage, as noted, usually occurs between the thread brake and the takeup package, and thus stray remnant pieces of thread will appear in the machine, which have a length corresponding to the length of the filament between the actual break position and the cutter. The stray remnant pieces thus are positioned in the machine usually in that area which is used to knot thread which was cut because it was off-size to the remainder of the thread already spooled, or within the spooling mechanism itself. Removal of such remnant thread is difficult and it frequently happens that the stray remnants are carried along by subsequently spooled thread portions, to be wound up together with the yarn package which detracts from its overall quality.

It has been proposed to remove such stray remnant pieces by locating suction nozzles above and close to the yarn cleaning apparatus - that is, the apparatus which determines the size of the filament and provides an "off-size" signal if beyond tolerance limits. The suction nozzles continuously apply a suction air current on the filament being spooled, which applies an additional continuous loading thereon. The accessibility of the apparatus, particularly in the region where the filament passes through components thereof, is impaired; additionally, considerable energy is required to generate the necessary air suction, due to the high volume being handled. In spite of substantial energy use and component requirements, it still was not possible to reliably remove all stray remnant thread or yarn pieces.

THE INVENTION

It is an object to improve spooling machines, and more particularly multiple-spindle spooling machines, by avoiding generation of stray remnant pieces of filaments.

Briefly, the signal generated by the yarn cleaning apparatus, that is, the "off-size" signal, is being made ineffective with respect to the filament cutting or severing apparatus if the filament has broken.

The apparatus and method has the advantage that, with low requirements of materials and none of energy, the generation of loose remnant pieces of filament can be avoided entirely. Not only are the operating costs substantially reduced, but the quality of the product, that is, of the thread or yarn being spooled, is substantially improved.

In accordance with a feature of the invention, a control signal is derived representative of filament tension. When the tension signal exceeds a certain limit, indicative of breakage of the filament, a control signal is derived which is caused to interrupt the electrical circuit of an electrical yarn cutting or severing apparatus.

Erroneous response which may occur due to the presence of instantaneous irregularities can be avoided by storing the operating signal derived from the yarn cleaning apparatus and applying it to the severing or cutting apparatus with some time delay.

In accordance with a feature of the invention, the electrical signal output of the tension sensor is connected to a threshold switch, the output of which controls the current flow being applied to the filament cutting or severing apparatus.

DRAWINGS

Figure 1:
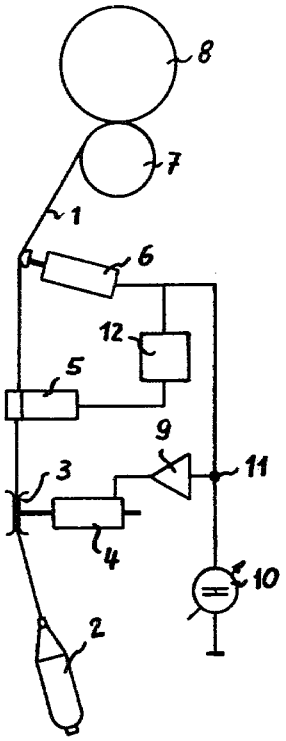
FIG. 1 is a highly schematic representation of a spooling position in an automatic crosswound yarn package spooling apparatus of the multiple-spindle type, of which only a single spindle position is shown for simplicity.

An automatic crosswound multiple-spindle machine has a spindle position as shown in FIG. 1. The filament 1 is spooled off a payout cop or pirn 2, passes through a thread brake 3 and is then guided through an electronic yarn cleaning apparatus 5. The thread brake applies a braking force which is electromagnetically controlled by an electromagnet 4. After passing through the electronic yarn cleaning apparatus 5, where the size of the filament 1 is determined, it passes by a thread tension sensor 6 and is then guided over a traverse control drum 7 for spooling on a takeup package spool 8.

The tension sensor 6 is connected to a controller, for example a proportion-integral controller 9, to the electromagnet 4. A controllable reference source 10 is connected to summing junction 11 between the tension sensor 6 and the controller 9. Controlling tension of filaments being spooled off spool 2 unto takeup spool 8 utilizing such a system is well-known—see, for example, Swiss Patent No. 439,791.

The filament cleaning device 5 is used to remove regions of the filament which are of excessively thick or excessively thin diameter. The filament is severed and re-knotted. The filament cleaning device 5 may operate on an optical or capacitative sensing principle by passing the filament through a measuring cell 50 of appropriate construction, and providing an "off-size" signal if the filament does not meet required dimensions, that is, is either too thick or too thin. The sensing signal is continually generated as the filament passes through the measuring cell. The path of the filament through the cell itself may vary or oscillate; the sensor 5 will also respond with an "off-size" output signal if the filament should break since the change in position of the filament with respect to its normal tensioned position within the sensing field in the cell will cause the thread cleaning apparatus 5 to respond.

Figure 2:
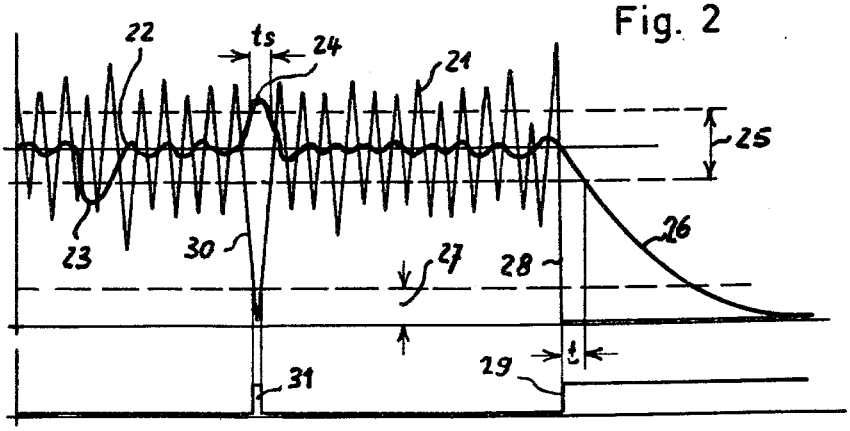
FIG. 2 is a graphic representation of thread tension and of consequent signals derived from the yarn cleaning and tension sensing apparatus and which arise in the system of the present invention.

The signals which arise in the system are graphically represented in FIG. 2: The thread cleaning apparatus 5 provides an electrical voltage represented by curve 22 which is proportional to the diameter of the filament 1. Thin regions or locations in the filament 1 cause a lower signal, as seen at 23; thickened portions 24 cause an increased signal. If the thin or thick portions exceed a certain tolerance limit which is set by the reference source 10 and schematically indicated by broken lines 25, an "off-size" signal is generated to sever or cut the filament. If, due to a break of the filament, the filament falls out of the measuring cell, the voltage of the output cells will drop to zero, as seen in the curve portion 26. This also will cause generation of an "off-size" signal, resulting in the equipment of the prior art, in a cutting operation.

In accordance with the present invention, the operating signal to cut or sever the filament is to be made ineffective if the filament should have broken; this is accomplished by utilizing the thread tension sensor 6 (FIG. 1) which provides an output signal 21 (FIG. 2).

The thread tension signal derived from tension sensor 6 continuously varies or oscillates about an average or mean value—see curve 21, FIG. 2. When the signal from sensor 6 drops below a predetermined threshold level 27, the limit of which is indicated by a broken line, threshold switch 12 responds and interrupts the current supply to a cutter knife of the thread cleaning apparatus 5. The cutter knife or blade is blocked after the time of position 29, and no severing or cutting of the filament will occur. As can be seen from FIG. 2, a break in the filament 1 causes an instantaneous loss of tension—see curve portion 28 of curve 21 - although the drop in output voltage from the filament cleaning apparatus 5 will follow the curve portion 26. There is a time delay t between break of the filament, and hence loss of tension and generation of the "off-size" signal due to the tolerance range 25.

The situation may occur that a thin portion as represented by signal 23, or a thickened portion as represented by signal 24, appears simultaneously with a drop in tension—see portion 30 of curve 21. This condition can arise due to short-time or instantaneous slip-through. The cutter blade would then be blocked, see curve portion 31, FIG. 2, and the required cut to remove the thickened portion 24 would not occur. To prevent spooling of substantial quantity of "off-size" filament, the signal from the filament sensor 5 is stored. If the "off-size" signal persists for a longer period ts, for example one second, the stored "off-size" signal then will become effective if the tension reverts back to normal; thus, short-time or instantaneous loss of tension will not prevent a cut if an "off-size" signal, see curve portions 23, 24, is sensed; the required cut of the filament will then not be prevented but, rather, at the worst will be delayed for a short period, that is, until the thread tension has again exceeded the tension threshold 27.

Formation of remnant loose pieces of filament is thus reliably prevented, without commercially detracting from the filament cleaning quality, that is, the "on-size" quality of the filament being spooled on spool 8; the apparatus is simple, reliable, and does not require any substantial continued operating energy.

Figure 3:
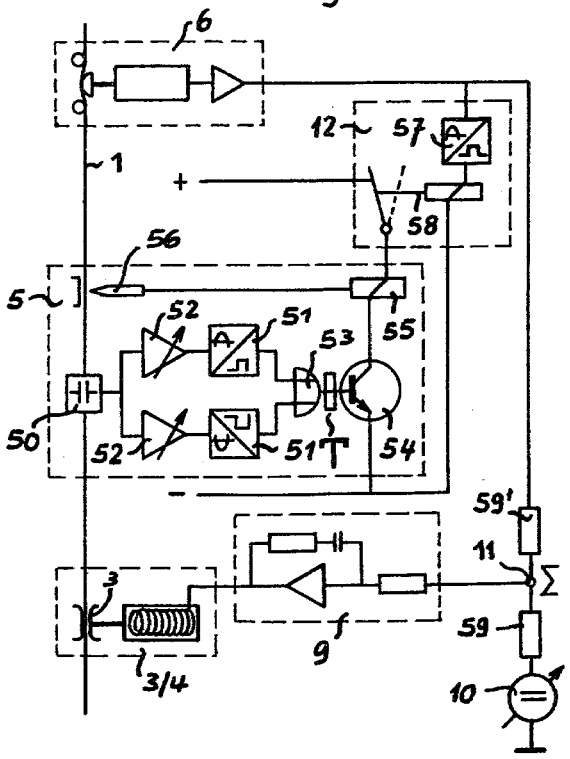
FIG. 3 is a schematic circuit diagram of the system and in connection with which the method of the present invention will be explained.

The system shown generally in FIG. 1 can be constructed in various ways; a simple and preferred embodiment is shown in FIG. 3.

The tension sensor 6 can be in accordance with any commercially available structure. A sensed mechanical tension of a moving filament is converted into an electric voltage representative of the tension. The actual sensing element can be a strain gauge strip, a piezoelectrical crystal system, or the like. Tension sensors are also known which operate based on control of a magnetic field.

The thread cleaning device 5 has a photoelectric or capacitative sensing cell 50 and a threshold switch 51, having threshold levels which are controllable by the control setting element 52. The output of the threshold switch 51 is applied through a gate 53 to a switching transistor 54 which is in circuit with a solenoid 55 which, in turn, operates a cutter knife 56. As shown, the threshold-set elements 52 are two controlled-gain amplifiers, connected in parallel, one setting an upper threshold level and one a lower threshold level, connected to respective operational amplifiers 51, the outputs of which, respectively, are connected to gate 53.

Loose remnant pieces of filament are prevented by operation of the threshold switch 12. Threshold switch 12 has a threshold circuit 57 and a switching relay 58. The switching relay may be an electronic solid-state circuit element. The relay 58 interrupts the circuit from a power supply + to the solenoid 55 which operates the cutter 56 if, due to loss of filament tension, the threshold switch 57 responds.

Thread brake 3, 4 includes a solenoid or electromagnetic coil 4 which acts as a brake or drag element. Current flow through the solenoid 4, and controlling the drag of the brake, is controlled by a proportional-integral (PI) controller. A set or command source 10, in the form of a controllable voltage sorce, provides an output signal through a coupling resistor 59 to a summing junction 11. The summing junction 11 has the output signal from the tension sensor 6 coupled thereto through coupling resistor 59'. The output from the summing junction 11 is applied through the PI controller 9 to the solenoid 4.

The time delay $t_s$ of response of the cutter preferably is provided by a storage and delay circuit which forms part of the threshold circuits 51, that is, for example an R/C circuit coupled to the output of the respective threshold circuits 51 to enable the gate 53 only if the "off-size" signal, as detected by the respective threshold circuit 51, persists. Alternatively, a delay circuit T can be included between the gate 53 and transistor 54, or the relay 55 can be constructed as a delayed-response relay. Relay 58 responds instantaneously upon sensing loss of tension by the tension sensor 6 so that a circuit through solenoid 55 between a positive and negative supply bus cannot be completed even if transistor 54 is controlled to conduction, by change-over of the contact of relay 58 to the broken-line position.

Various changes and modifications may be made within the scope of the inventive concept.

I claim:

1. In a spooling machine, a method to prevent formation of stray cut filament pieces, wherein the filament is spooled with controlled tension from a payout spool (2) to a takeup spool (8), and which includes sensing means (50) and a thread cutting apparatus (56) positioned in the path of the thread from the payout spool to the takeup spool, and responsive to an "off-size" signal to sever the thread if an "off-size" signal is sensed.

which comprises, in accordance with the invention, the steps of sensing thread tension and deriving a tension signal;

and inhibiting application of the "off-size" signal to the thread cutting apparatus (56) upon failure to sense the tension signal, to prevent cutting of thread which has broken, resulting in failure of filament tension, regardless of the presence of an "off-size" signal from the thread size sensing means (5).

2. Method according to claim 1, including the step of analyzing the thread tension signal to determine its level with respect to a reference;

and wherein the step of inhibiting application of the "off-size" signal to the cutting apparatus comprises inhibiting said signal if a predetermined threshold level of the tension signal is passed.

3. Method according to claim 1, further including the step of storing the "off-size" signal for a predetermined short time delay period (ts), and applying the "off-size" signal to the thread cutting apparatus with said time delay if the signal persists during said period.

4. In a spooling machine, apparatus to prevent the formation of cut filament pieces in which a filament is spooled from a payout spool (2) to a takeup package (8), and having means (5, 50) sensing thread size and providing an "off-size" signal if the thread size is outside of predetermined limits, a thread cutting apparatus (5, 56) positioned in the path of thread from the payout spool to the takeup package, and responsive to the "off-size" signal to sever the thread if an "off-size" signal is sensed, and means (6) deriving a tension signal representative of filament tension as the filament is being spooled from the payout spool to the takeup package, and comprising, in accordance with the invention, circuit interrupt means (58) connected to and controlling operation of the thread cutting apparatus (56), and responsive to the tension signal derived from the tension signal generating means, and connected to inhibit operation of the thread cutting apparatus upon failure of the tension signal generating means to sense a predetermined tension of filament being spooled.

5. Apparatus according to claim 4, including a threshold circuit (12) connected to and controlled by the tension signal generating means (6) and providing a cut-inhibiting signal when the tension of the filament being spooled from the payout spool (2) to the takeup package (8) drops below a predetermined value.

6. Apparatus according to claim 5, wherein the apparatus further includes a thread brake (3, 4) connected to and controlled by the tension sensing means (6) to form a closed control loop therefor;

and wherein the threshold switch (12) is connected in circuit with said closed control loop to branch off and be responsive to the thread tension signal.

7. Apparatus according to claim 4, further including time delay circuit means connected between the thread size sensing means (50) and the thread cutting apparatus (56) to store an "off-size" signal and apply said stored "off-size" signal to the thread cutting apparatus with a predetermined time delay (ts) upon continued persistence thereof to insure cutting of the filament by the thread cutting apparatus (56) in case of short-time failure of the thread tension sensing means to sense thread tension.

* * * * *